US009110421B2

(12) United States Patent
Hayashi

(10) Patent No.: US 9,110,421 B2
(45) Date of Patent: Aug. 18, 2015

(54) IMAGE FORMING APPARATUS, METHOD AND A NON-TRANSITORY, COMPUTER-READABLE STORAGE MEDIUM THEREFOR

(71) Applicant: BROTHER KOGYO KABUSHIKI KAISHA, Nagoya-shi, Aichi-ken (JP)

(72) Inventor: Akihiro Hayashi, Komaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/517,346

(22) Filed: Oct. 17, 2014

(65) Prior Publication Data

US 2015/0117889 A1 Apr. 30, 2015

(30) Foreign Application Priority Data

Oct. 28, 2013 (JP) ..... 2013-223121

(51) Int. Cl.
*G03G 15/00* (2006.01)
*G03G 15/02* (2006.01)

(52) U.S. Cl.
CPC ..... *G03G 15/5016* (2013.01); *G03G 15/02* (2013.01)

(58) Field of Classification Search
CPC ..... G03G 15/5016; G03G 15/502
See application file for complete search history.

(56) References Cited

U.S. PATENT DOCUMENTS 6,748,183 B2 * 6/2004 Edmonds ..... 399/23
8,970,858 B2 * 3/2015 Akiyama et al. ..... 358/1.13
2004/0009003 A1 1/2004 Kim

FOREIGN PATENT DOCUMENTS

JP 2002-278377 A 9/2002
JP 2003-107964 A 4/2003
JP 2004-034711 A 2/2004

* cited by examiner

*Primary Examiner* — Gregory H Curran
(74) *Attorney, Agent, or Firm* — Scully, Scott, Murphy & Presser, P.C.

(57) ABSTRACT

An image forming apparatus includes a control device that detects a change in a first state concerning placement and removal of sheets in a sheet feed device or mounting and demounting of the sheet feed device and detects a second change in a second state concerning placement and removal or mounting and demounting of a member. When the control device detects the first change, the control device displays, on a display, first display information prompting for the user to enter settings concerning the type of sheets to be supplied to the sheet feed device. After accepting settings, the control device counts a predetermined time and deletes the first display information. When detecting the second change, the control device displays the display information for a longer time. Accordingly, when the user checks or sets the first display information about sheets, convenience is improved.

13 Claims, 6 Drawing Sheets

Fig.5A

| TRAY NAME | SEQUENCE | TIME-OUT COUNT |
|---|---|---|
| TRAY 51A | 1 | NOT STARTED |
| TRAY 51B | 2 | NOT STARTED |
| TRAY 51C | 3 | STARTED |
| MP TRAY 51D | 4 | NOT STARTED |

Fig.5B

| TRAY NAME | SEQUENCE | TIME-OUT COUNT |
|---|---|---|
| TRAY 51A | 1 | NOT STARTED |
| TRAY 51B | 2 | NOT STARTED |
| TRAY 51C | 3 | NOT STARTED |
| MP TRAY 51D | 4 | NOT STARTED |

IMAGE FORMING APPARATUS, METHOD AND A NON-TRANSITORY, COMPUTER-READABLE STORAGE MEDIUM THEREFOR

CROSS-REFERENCE TO RELATED APPLICATION

This application claims priority from Japanese Patent Application No. 2013-223121, filed on Oct. 28, 2013, which is incorporated herein by reference in its entirety.

TECHNICAL FIELD

The disclosure relates to an image forming apparatus that has a display on which information about a sheet accommodated in a sheet feed device is displayed, a method of displaying the sheet information on the display of the image forming apparatus, and a non-transitory, computer-readable storage medium that stores instructions executed by the image forming apparatus.

BACKGROUND

An image forming apparatus is known that displays, on a display, information about sheets accommodated in a sheet feed device when the sheet feed device is placed in a body of the image forming apparatus or when the sheet feed device is demounted from the body. The displayed sheet information prompts the user to set new information about sheets accommodated in the sheet feed device.

SUMMARY OF THE DISCLOSURE

In the above structure, the sheet information displayed on the display may be deleted after the elapse of a predetermined time. In this case, the sheet information may be deleted before the user checks the sheet information, sets new sheet information, or takes another action.

The disclosure addresses the above problem with the object of providing an image forming apparatus, a method, and a non-transitory, computer-readable storage medium that improve convenience when, for example, the user checks sheet information displayed on a display and sets new sheet information on it.

According to an aspect of the disclosure, an image forming apparatus includes an body, a sheet feed device, an image forming device configured to form an image on a sheet fed from the sheet feed device, a first sensor configured to output a first signal according to a first state concerning placement and removal of a sheet in the sheet feed device or output a first signal according to a first state concerning mounting and demounting of the sheet feed device, a second sensor configured to output a second signal according to a second state concerning placement and removal or mounting and demounting of a member, the member being placement and removal in another sheet feed device or being mounted in and demounted from the body, a display, and a control device. The control unit may be configured to: detect a first change in the first state based on the first signal output from the first sensor; detect a second change in the second state based on the second signal output from the second sensor; control the display to display first display information that prompts setting of a setting concerning a type of a sheet to be supplied to the sheet feed device on the display in response to the detection of the first change; count a time, the counting being started after the first display information has been displayed on the display;

delete the first display information from the display after a prescribed time has been counted; and extend a display time displaying the first display information on the display, when the second change is detected while the first display information is displayed on the display, the display time is extended compared with a case in which, the second change is not detected while the first display information is displayed on the display.

According to another aspect of the disclosure, an information displaying method of an image forming apparatus that includes an body, a sheet feed device, an image forming device configured to form an image on a sheet fed from the sheet feed device, a first sensor configured to output a first signal according to a first state concerning placement and removal of a sheet in the sheet feed device or output a first signal according to a first state concerning mounting and demounting of the sheet feed device, a second sensor configured to output a second signal according to a second state concerning placement and removal or mounting and demounting of a member, the member being placement and removal in another sheet feed device or being mounted in and demounted from the body, and a display. The information displaying method may include: detecting a first change in the first state based on the first signal output from the first sensor; detecting a second change in the second state based on the second signal output from the second sensor;

controlling the display of first display information that prompts setting of a setting concerning a type of a sheet to be supplied to the sheet feed device on the display in response to detecting the first change; counting a time, the counting being started after the first display information has been displayed on the display; deleting the first display information from the display after a prescribed time has been counted; and extending a display time displaying the first display information on the display, when the second change is detected while the first display information is displayed on the display, the display time is extended as compared with a case in which the second detection processing is not performed while the first display information is displayed on the display.

According to another aspect of the disclosure, a non-transitory, computer-readable storage medium may store computer-readable instructions executed by at least one processor of an image forming apparatus that includes a body, a sheet feed device, an image forming device configured to form an image on a sheet fed from the sheet feed device, a first sensor configured to output a first signal according to a first state concerning placement and removal of a sheet in the sheet feed device or output a first signal according to a first state concerning mounting and demounting of the sheet feed device, a second sensor configured to output a second signal according to a second state concerning placement and removal or mounting and demounting of a member, the member being placement and removal in another sheet feed device or being mounted in and demounted from the body, and a display. The instructions may instruct an image forming apparatus to execute: detecting a first change in the first state based on the first signal output from the first sensor; detecting a second change in the second state based on the second signal output from the second sensor; controlling the display of first display information that prompts setting of a setting concerning a type of a sheet to be supplied to the sheet feed device on the display in response to detecting the first change; counting a time, the counting being started after the first display information has been displayed on the display; deleting the first display information from the display after a prescribed time has been counted; and extending a display time displaying the first display information on the display, when the second change is detected while the first display information is displayed on the display, the display time is extended as compared with a case in which the second change is not detected while the first display information is displayed on the display.

According to the disclosure, convenience is improved when, for example, the user checks sheet information displayed on a display and sets new sheet information on it.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

FIG. 5A schematically illustrates a demounting sequence table, and FIG. 5B schematically illustrates another demounting sequence table indicating a demounting sequence different from FIG. 5A.

DETAILED DESCRIPTION

Figure 1:
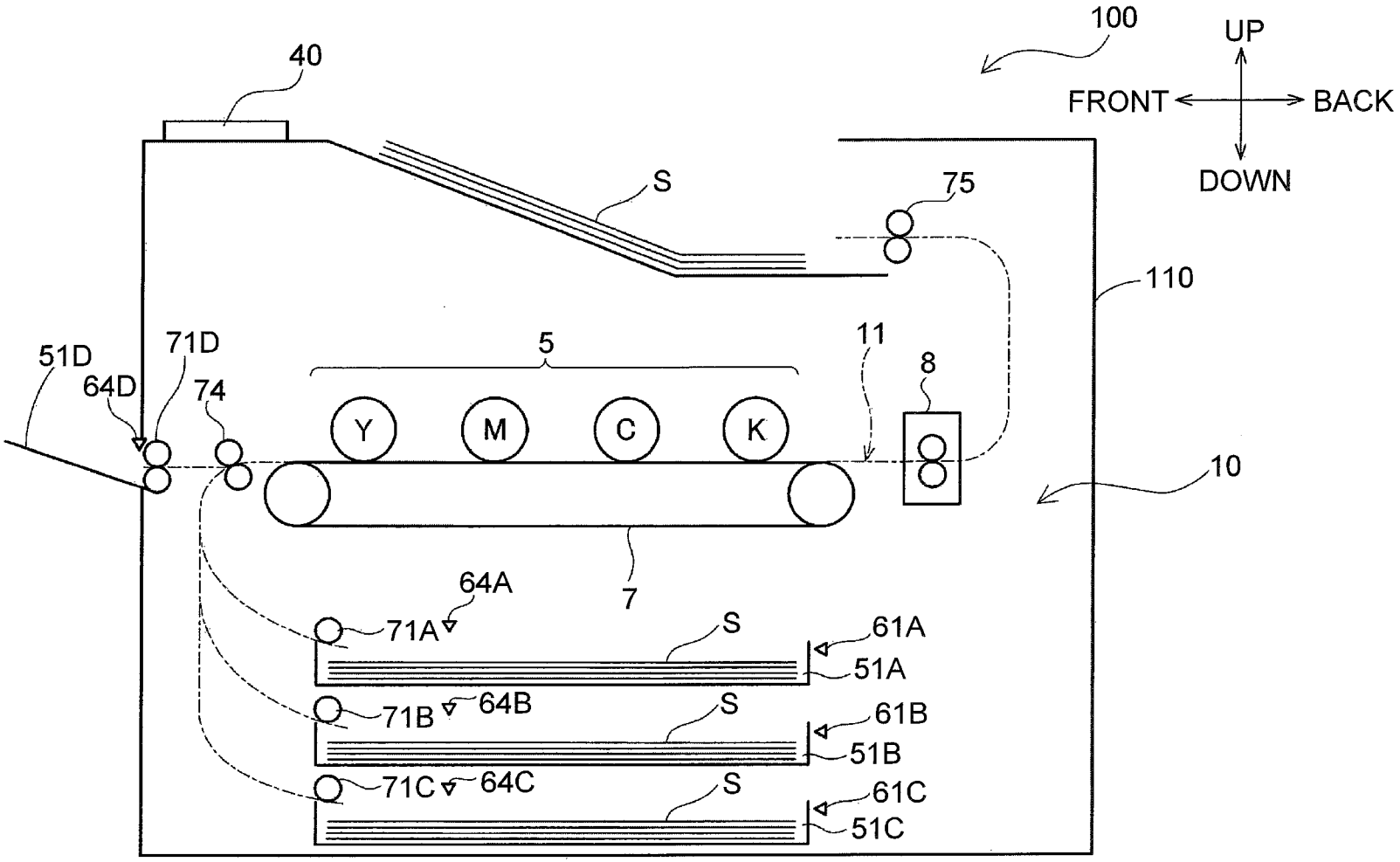
FIG. 1 illustrates an example of a structure of a printer in an embodiment of the disclosure.

Various embodiments will be described in detail with reference to the drawings, wherein like reference numerals represent like parts. Reference to various embodiments does not limit the scope of the claims attached hereto. Additionally, any example set forth in the specification are not intended to be limiting and merely set forth some of the many possible embodiments for the appended claims.

First Embodiment

As illustrated in FIG. 1, printer 100 in this embodiment mainly has a body cabinet 110 (an example of an body), a printing device 10 (an example of an image forming device), a manipulation panel 40, and feed trays 51A, 51B, 51C and 51D (examples of sheet feed devices).

The printing device 10, which may be located in the body cabinet 110, mainly may have a process device 5 that forms a toner image on a sheet S (an example of a member that is placed and removed) in a known electrophotographic method, a conveying belt 7 that conveys the sheet S along the process device 5, and a fixing device 8 that fixes the formed tonner image on the sheet S. This printing device 10 enables a desired image to be printed on the sheet S.

The manipulation panel 40, which may be located on the upper surface of the body cabinet 110, may have a display 41 (see FIG. 2) and buttons including a start key, a stop key, and a numeric keypad. The manipulation panel 40 may display an operation status of the printer 100 and enables the user to perform input manipulations. Examples of input manipulations by the user are to enter a print instruction that commands the printing device 10 to perform printing and to enter a setting of the type of a sheet S to be supplied to a feed tray 51 while a setting screen 45 (see FIG. 2) corresponding to the feed tray 51 is displayed on the display 41. The display 41 is an example of a display in the disclosure. The setting screen 45 is an example of display information in the disclosure.

Each feed tray 51, which may be located at the bottom of the body cabinet 110 and at its front, may accommodate a stack of sheets S on which to form images. As the feed trays 51, the printer 100 in this embodiment may have four trays, which are the feed trays 51A, 51B and 51C located at the bottom of the body cabinet 110 and a multi-purpose (MP) feed tray 51D located at the front of the body cabinet 110. The feed trays 51A, 51B, and 51C may be each structured so that they may be drawn toward the front of the body cabinet 110 and the drawn feed trays 51A, 51B, and 51C may be inserted into the body cabinet 110. While the feed trays 51A, 51B, and 51C are drawn from the body cabinet 110, the user may stack sheets S on the feed trays 51A, 51B, and 51C. While the feed trays 51A, 51B, and 51C are mounted in the body cabinet 110, the printer 100 may supply sheets S from the feed trays 51A, 51B, and 51C.

The user may also stack sheets S in the MP tray 51D.

The feed trays 51A, 51B, 51C, and 51D respectively may have supply rollers 71A, 71B, 71C, and 71D, each of which may feed out stacked sheets S to a conveying path 11. A sheet S to be used in the printing device 10 for printing may be supplied from the feed tray 51A, 51B or 51C or the MP feed tray 51D, whichever is applicable, by the relevant supply roller 71A, 71B, 71C, or 71D, may be conveyed to the process device 5 through the relevant conveying path 11, and may be subjected to printing by constituent elements of the printing device 10. In FIG. 1, conveying paths 11 are indicated by dash-dot lines. Roller pairs 74 and 75, which may convey a sheet S, are provided on the conveying path 11. When a sheet S is fed out from any one of the feed trays 51, the roller pair 74 may convey the sheet S to the printing device 10. After printing has been performed by the printing device 10, the roller pair 75 may discharge the printed sheet S to an external upper portion of the body cabinet 110. Each conveying path 11 extends from its corresponding feed tray 51 to a position at which conveyance by the roller pair 75 is terminated.

Next, setting screens 45 will be described in more detail with reference to FIG. 2. Although setting screens 45A and 45B are illustrated as examples in FIG. 2, other setting screens 45 also have the same structure as described below.

Each setting screen 45 is a display screen on which the type (size, class, etc.) of the sheet S to be supplied to the relevant feed tray 51. Since the printer 100 lacks sensors or similar devices that detect the type of the sheet S to be supplied to the feed trays 51, the user needs to set the type of the sheet S to be supplied to each feed tray 51.

A setting screen 45 may be displayed in a situation in which sheets S may be replaced as when the relevant feed tray 51 has been drawn from the body cabinet 110 or a situation in which sheets S may have been replaced as when sheets S have been placed in the feed tray 51D.

Figure 2:
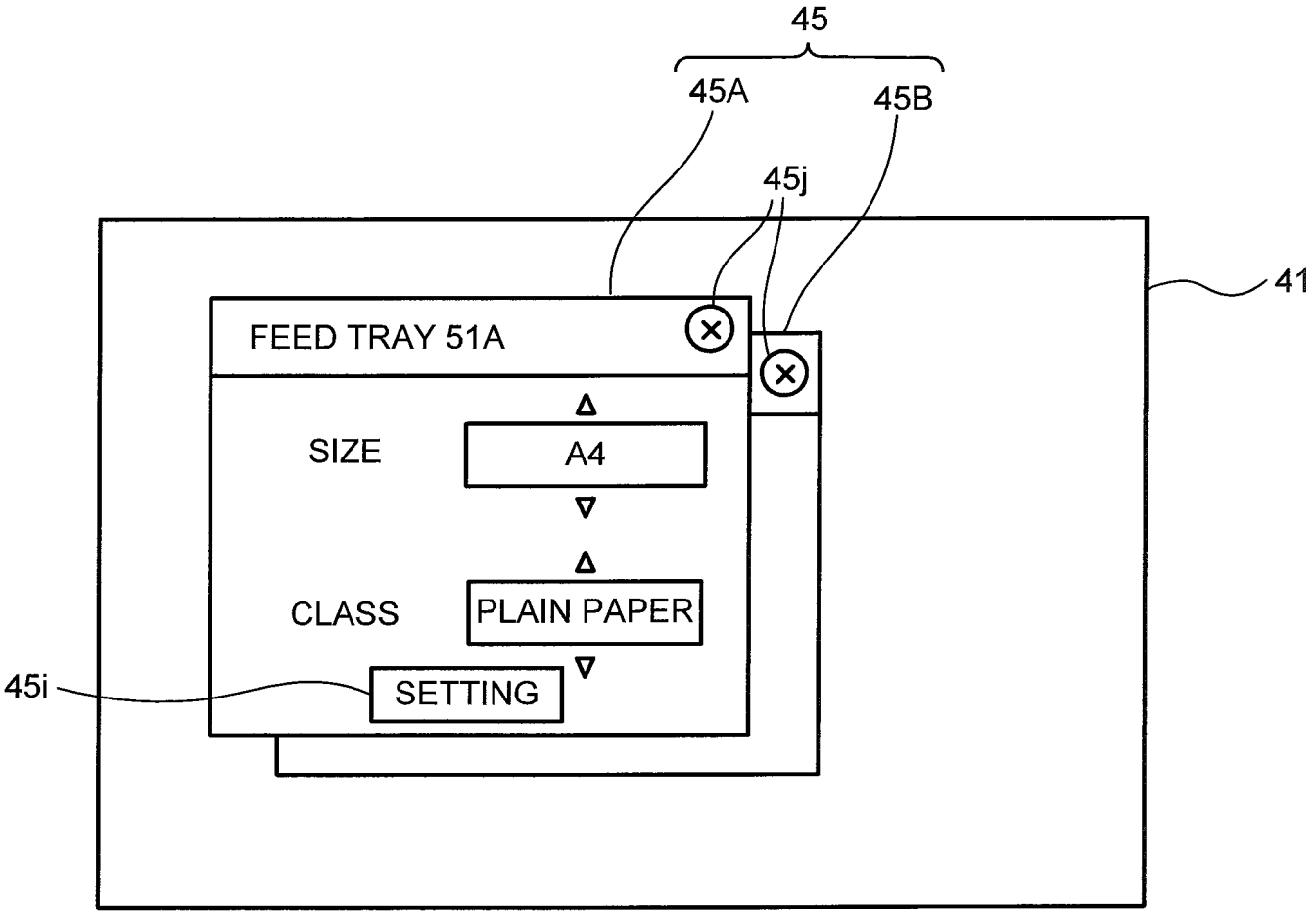
FIG. 2 schematically illustrates examples of setting screens displayed on a display.

As illustrated in FIG. 2, the setting screen 45 may be structured so as to display the current settings of the type of the sheets S in the relevant feed tray 51, accept user's manipulations to change the type of the sheet S to new settings, and complete the setting of the new type when the user selects a setting button 45*i*. To leave the current settings unchanged or cancel the new settings, the user may select a deletion button 45*j*, in which case the setting screen 45 is deleted with the current settings unchanged.

The setting screen 45 may also be deleted from the manipulation panel 40 after the elapse of a predetermined time, besides the selection of the deletion button 45*j*. Thus, when the user thinks that the settings of the type of the sheet does not need to be changed, the setting screen 45 can be deleted after the elapse of a predetermined time without the user taking the trouble of selecting the deletion button 45*j* to delete the setting screen 45.

If any feed tray 51 is not specified in a print instruction accepted from the user, the printer 100 may select a feed tray 51 and may perform printing. Specifically, the printer 100 may reference the type of the sheets S placed in each feed tray 51, the type having been set as described, and may select a feed tray 51 for which the type of the sheet S that matches the settings of the type of the sheet S corresponding to print data is set, after which the printer 100 may supply sheets S from the selected feed tray 51.

In this embodiment, if a plurality of setting screens 45 are displayed, they may be displayed so as to be partially overlaid as illustrated in FIG. 2, but this is not a limitation. For example, the plurality of screens may be completely overlaid or may be titled.

Figure 3:
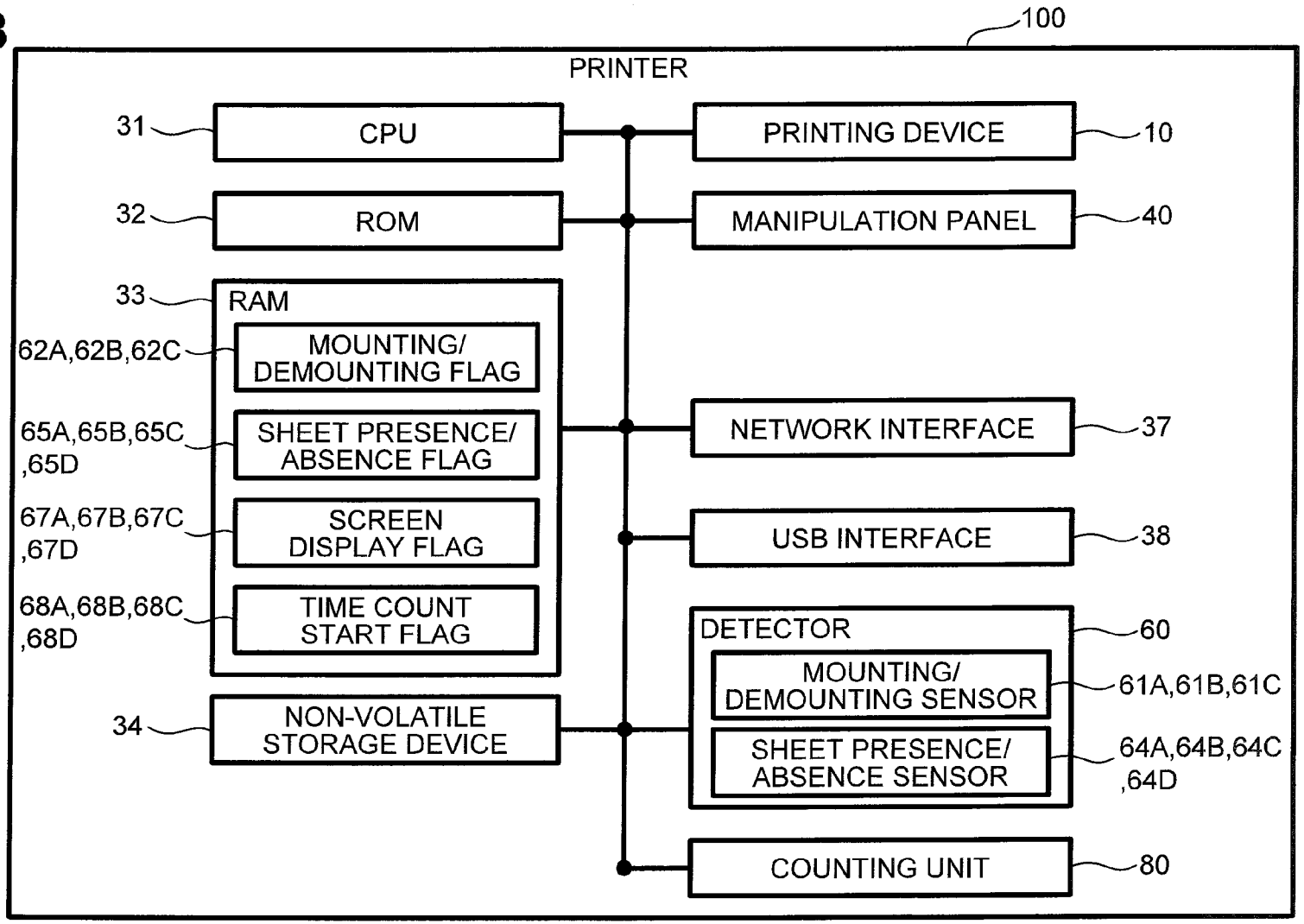
FIG. 3 is a block diagram depicting an example electric structure of the printer.

Next, the electric structure of the printer 100 will be described. As illustrated in FIG. 3, the printer 100 may have a central processing unit (CPU) 31 (an example of a control device or a processor), a read-only memory (ROM) 32, a random-access memory (RAM) 33, a non-volatile storage device 34, a printing device 10, the manipulation panel 40, a network interface 37, a universal serial bus (USB) interface 38, detectors 60 (examples of a first sensor and a second sensor), and a counting unit 80.

The ROM 32 may store various control programs that control the printer 100, as well as settings, initial values, and the like.

The RAM 33 may be used as a work area from which various control programs are read out or as a storage area in which data is temporarily stored. The CPU 31 may control the constituent elements of the printer 100 under control of the control programs read out from the ROM 32; during the control, the CPU 31 may store processing results in the RAM 33 or non-volatile storage device 34. In particular, the RAM 33 may store mounting/demounting flags 62A, 62B and 62C in correspondence to the feed trays 51A, 51B and 51C, sheet presence/absence flags 65A, 65B, 65C and 65D in correspondence to the feed trays 51A, 51B and 51C and the MP feed tray 51D, screen display flags 67A, 67B, 67C and 67D in correspondence to the feed trays 51A, 51B and 51C and the MP feed tray 51D, and time count start flags 68A, 68B, 68C, and 68D in correspondence to the feed trays 51A, 51B and 51C and the MP feed tray 51D.

When the process device 5, conveying belt 7, fixing device 8, and the like are controlled by the CPU 31, the printing device 10 may perform printing on the sheet S supplied from the feed tray 51.

As for the manipulation panel 40, the operation status displayed on the display 41 illustrated in FIG. 2 may be controlled by the CPU 31. The manipulation panel 40 may also transmit a signal generated in response to the user's input manipulation to the CPU 31.

The network interface 37 and USB interface 38 may be connected to an external computer (not illustrated) or like through, for example, a communication line or a USB cable, enabling mutual data communication. For example, the network interface 37 and USB interface 38 may accept a print instruction that commands the printing device 10 to perform printing and receive image data used for printing.

The detectors 60 may have mounting/demounting sensors 61A, 61B and 61C (example of mounting/demounting sensors) corresponding to the feed trays 51A, 51B and 51C and sheet presence/absence sensors 64A, 64B, 64C and 64D corresponding to the feed trays 51A, 51B and 51C and the MP feed tray 51D.

The mounting/demounting sensors 61A, 61B, and 61C, which may be each an optical sensor, may be respectively disposed behind the feed trays 51A, 51B, and 51C. The mounting/demounting sensors 61A, 61B, and 61C may respectively emit light toward the feed trays 51A, 51B, and 51C to transmit, to the CPU 31, two types of signals having different reflected light intensities, which change according to the distances between the mounting/demounting sensors 61A, 61B and 61C and the feed trays 51A, 51B and 51C in the front-back direction. In particular, the mounting/demounting sensors 61A, 61B, and 61C may respectively transmit two types of signals to the CPU 31, depending on whether the feed trays 51A, 51B, and 51C are in a demounting state (an example of a demounting state) or an mounting state (an example of the mounting state). In the demounting state, the feed trays 51A, 51B, and 51C may be partially or completely drawn from the body cabinet 110. In the mounting state, the feed trays 51A, 51B, and 51C may be mounted in the body cabinet 110 and may be completely accommodated in the body cabinet 110. The mounting/demounting sensor 61 is not limited to the structure described above. If the mounting/demounting sensor 61 may transmit different signals depending on whether the relevant feed tray 51 is mounted or demounted, the mounting/demounting sensor 61 may have any structure. The CPU 31 may set the mounting/demounting flags 62A, 62B, and 62C according to the signals from the mounting/demounting sensors 61A, 61B, and 61C. Specifically, if these signals indicate that the feed trays 51A, 51B, and 51C are demounted, the CPU 31 may stores 1 in their corresponding mounting/demounting flags 62A, 62B, and 62C. Similarly, if these signals indicate that the feed trays 51A, 51B, and 51C are mounted, the CPU 31 may store 0 in their corresponding mounting/demounting flags 62A, 62B, and 62C.

The sheet presence/absence sensors 64A, 64B, 64C, and 64D, which may be each an optical sensor, may be respectively disposed above the feed trays 51A, 51B and 51C and the MP feed tray 51D. The sheet presence/absence sensors 64A, 64B, 64C, and 64D may respectively emit light toward the feed trays 51A, 51B and 51C and the MP feed tray 51D, that is, downwardly, to transmit, to the CPU 31, two types of signals having different reflected light intensities. In particular, sheet presence/absence sensors 64A, 64B, 64C, and 64D may respectively transmit two types of signals to the CPU 31, depending on whether sheets S are placed in the feed trays 51A, 51B and 51C and the MP feed tray 51D. The sheet presence/absence sensors 64A, 64B, 64C, and 64D are not limited to the structure described above. If the sheet presence/absence sensors 64A, 64B, 64C, and 64D can transmit different signals depending on whether sheets are placed in the feed trays 51, the sheet presence/absence sensors 64A, 64B, 64C, and 64D can have any structure. The CPU 31 may set the sheet presence/absence flags 65A, 65B, 65C, and 65D according to the signals from the 64A, 64B, 64C, and 64D. Specifically, if these signals indicate that the feed trays 51A, 51B, 51C, and 51D include sheets, the CPU 31 may store 1 in their corresponding sheet presence/absence flags 65A, 65B, 65C, and 65D. Similarly, if these signals indicate that the feed trays 51A, 51B, 51C, and 51D lack sheets, the CPU 31 may store 0 in their corresponding sheet presence/absence flags 65A, 65B, 65C, and 65D.

The counting unit 80 may count time; the start and stop of the count may be controlled by the CPU 31. The counting unit 80 may be formed with a known timer or the like.

The screen display flags 67A, 67B, 67C and 67D and time count start flags 68A, 68B, 68C and 68D will be described below in more detail.

First, the screen display flags 67A, 67B, 67C and 67D will be described in more detail.

If the CPU 31 decides that setting screens 45A, 45B, 45C, and 45D corresponding to the feed trays 51A, 51B, 51C, and 51D should be displayed, the CPU 31 may store 1 in the screen display flags 67A, 67B, 67C, and 67D. If not, the CPU 31 may store 0 in these flags.

In setting screen display processing, which will be described later in detail, the CPU 31 may decide, depending on the value of each screen display flag 67, whether to display the setting screen 45 corresponding to the relevant feed tray 51 on the manipulation panel 40.

A case in which 1 is stored in one screen display flag 67 is when sheets S may be replaced or sheets S may have been replaced, more specifically when the CPU 31 decides that the relevant feed tray 51 has been demounted or the state of the relevant feed tray 51 has changed from absence of sheets to presence of sheets. The demounting of the feed tray 51 may be decided by the CPU 31 from the value of the mounting/demounting flag 62A, 62B, or 62C, whichever is applicable, and from a signal output from the mounting/demounting sensor 61A, 61B, or 61C, whichever is applicable. A change from absence of sheets to presence of sheets may be decided by the CPU 31 from the value of the sheet presence/absence flag 65A, 65B, 65C, or 65D, whichever is applicable, and from signals output from the sheet presence/absence sensor 64A, 64B, 64C, or 64D, whichever is applicable.

More specifically, first, a case in which the CPU 31 decides, from the value of one mounting/demounting flag 62 and a signal output from the relevant mounting/demounting sensor 61, that the relevant feed tray 51 has been demounted and stores 1 in the relevant screen display flag 67 will be described by taking the feed tray 51A as an example.

When the user mounts the feed tray 51A in the printer 100 and the state of the feed tray 51A is thereby in the mounting state, the mounting/demounting sensor 61A may transmit a signal to the CPU 31 in correspondence to the mounting state. Then, the CPU 31 may set the value of the mounting/demounting flag 62A to 0. If, in this situation, the mounting/demounting sensor 61A transmits a signal to the CPU 31 in correspondence to the fact that the feed tray 51A eligible for detection is in the demounting state, the CPU 31 may decide that the feed tray 51A has been demounted from the printer 100 because the value of the mounting/demounting flag 62A corresponding to the feed tray 51A eligible for detection is 0. That is, the CPU 31 may decide that the feed tray 51A has changed from the mounting state to the demounting state and thereby may decide that the user may have demounted the feed tray 51A and may place sheets S in it. Then, the CPU 31 may set the value of the mounting/demounting flag 62A to 1 and stores 1 in the screen display flag 67A. When the relevant setting screen 45 is then displayed on the manipulation panel 40, the CPU 31 may change the value of the screen display flag 67A from 1 to 0. That is, since the relevant setting screen 45 has been displayed on the manipulation panel 40, the CPU 31 may change the value of the screen display flag 67A from the state in which there is a need to display the relevant setting screen 45 on the manipulation panel 40 to the state in which there is no need to display the relevant setting screen 45 on the manipulation panel 40. This is also true for the feed trays 51B and 51C.

Next, a case in which the CPU 31 decides, from the value of the sheet presence/absence flag 65A, 65B, 65C, or 65D and a signal output from the sheet presence/absence sensor 64A, 64B, 64C, or 64D, that the state of the relevant feed tray 51 has changed from absence of sheets to presence of sheets and sets 1 in the screen display flag 67A, 67B, 67C, or 67D, whichever is applicable, will be described by taking the feed tray 51A as an example.

If no sheet S is placed in the feed tray 51A because, for example, all the sheets S in the feed tray 51A have been subjected to printing, the sheet presence/absence sensor 64A may transmit a signal to the CPU 31 in correspondence to the fact that no sheet S is placed in the feed tray 51A and the CPU 31 thereby may set the value of the sheet presence/absence flag 65A to 0. If, in this situation, the sheet presence/absence sensor 64A transmits a signal to the CPU 31 in correspondence to the fact that sheets S are placed in the feed tray 51A eligible for detection, the CPU 31 may decide that sheets S have been supplied to the feed tray 51A because the value of the sheet presence/absence flag 65A is 0. That is, the CPU 31 may decide that the state in which no sheet S is placed in the feed tray 51A has been changed to the state in which sheets S are placed in the feed tray 51A, and thereby may decide that the user has placed sheets S in the feed tray 51A. Then, the CPU 31 may set the value of the sheet presence/absence flag 65A to 1 and may store 1 in the screen display flag 67A. This is also true for the feed trays 51B and 51C and the MP feed tray 51D.

As described above, the CPU 31 may decide, from the value of the mounting/demounting flag 62A, 62B, or 62C and a signal output from the mounting/demounting sensor 61A, 61B, or 61C, that the relevant feed tray 51 has been demounted or may decide, from the value of the sheet presence/absence flags 65A, 65B, 65C, or 65D and a signal output from the sheet presence/absence sensors 64A, 64B, 64C, or 64D, that the state in which no sheet is placed has been changed to the state in which sheets are placed and thereby stores 1 in the relevant screen display flag 67. The above structure is not limited to a case in which the value of the screen display flag 67 is set to 1; any case is applicable if a situation in which the type of sheets S in the feed tray 51 may have been changed is detected. A specific example is a case in which, for example, the CPU 31 decides that the mounting/demounting state of the feed tray 51 has been changed or a change has occurred between absence of sheets and presence of sheets. For example, even in the case in which a value is stored in the screen display flag 67 according to the value of the mounting/demounting flag 62 and a signal output from the mounting/demounting sensor 61, when the value of the mounting/demounting flag 62 is 0 and the mounting/demounting sensor 61 transmits a signal in correspondence to the fact that the feed tray 51 eligible for detection is in the demounting state, the value of the screen display flag 67 may not be changed to 1. Instead, when the value of the mounting/demounting flag 62 is 1 and the mounting/demounting sensor 61 transmits a signal in correspondence to the fact that the feed tray 51 eligible for detection is in the mounting state, the value of the screen display flag 67 may be changed to 1. That is, when the demounting of the feed tray 51 is detected, the value of the screen display flag 67 may be changed to 1.

There is also no limitation to the mounting/demounting sensors 61 and sheet presence/absence sensors 64. Any sensors can be used if they can detect that the type of the sheets S in the feed tray 51 may have been changed.

In this embodiment, as for the feed trays 51A, 51B, 51C, when the values of their corresponding mounting/demounting flags 62A, 62B, and 62C are 0 and signals are output from their corresponding mounting/demounting sensors 61A, 61B, and 61C in correspondence to the demounting state, 1 may be stored in their corresponding screen display flags 67A, 67B, and 67C. As for the MP feed tray 51D, when the value of the sheet presence/absence flag 65D is 0 and a signal is output from the sheet presence/absence sensor 64D in correspondence to presence of sheets, 1 may be stored in the screen display flag 67D. That is, as for the feed trays 51A, 51B, and 51C, the relevant setting screens 45 may be displayed when they are demounted; as for the MP feed tray 51D, the relevant setting screen 45 may be displayed when sheets are supplied to it.

Next, the time count start flags 68A, 68B, 68C, and 68D will be described in more detail.

If the CPU 31 decides that count of the time elapsed until the display of the setting screen 45A, 45B, 45C, or 45D respectively corresponding to the feed tray 51A, 51B, 51C, or 51D is deleted should be started, the CPU 31 may store 1 in the time count start flag 68A, 68B, 68C, or 68D, respectively. If not, the CPU 31 may store 0 therein.

In setting screen display processing, which will be described later in detail, the CPU 31 may decide, depending on the value of each time count start flag 68, whether to start count of the time elapsed until the display of the setting screen 45 corresponding to the relevant feed tray 51 is deleted.

The CPU 31 may decide whether to store 1 in each time count start flag 68 according to a combination of the value of the mounting/demounting flag 62A, 62B, or 62C and a signal output from the mounting/demounting sensor 61A, 61B, or 61C or to a combination of the value of the sheet presence/absence flag 65A, 65B, 65C, or 65D and a signal output from the sheet presence/absence sensor 64A, 64B, 64C, or 64D, as with the screen display flag 67.

More specifically, first, a case in which the CPU 31 stores 1 in the time count start flag 68A, 68B, 68C, or 68D, according to the value of the relevant mounting/demounting flag 62A, 62B, or 62C and a signal output from the relevant mounting/demounting sensor 61A, 61B, or 61C will be described by taking the feed tray 51A as an example.

When the user demounts the feed tray 51A from the printer 100 and the state of the feed tray 51A is thereby in the demounting state, the mounting/demounting sensor 61A may transmit a signal to the CPU 31 in correspondence to the demounting state. Then, the CPU 31 may set the value of the mounting/demounting flag 62A to 1. If, in this situation, the mounting/demounting sensor 61A transmits a signal to the CPU 31 in correspondence to the fact that the feed tray 51A eligible for detection is in the mounting state, the CPU 31 may decide that the feed tray 51A has been mounted in the printer 100 because the value of the mounting/demounting flag 62A corresponding to the feed tray 51A eligible for detection is 1. That is, the CPU 31 may decide that the feed tray 51A has changed from the demounting state to the mounting state and thereby may decide that the user may have mounted the feed tray 51A and may have terminated the placing of sheets S. Then, the CPU 31 may set the value of the mounting/demounting flag 62A to 0 and may store 1 in the time count start flag 68A. The CPU 31 may then consider a particular condition as described later in detail, after which the CPU 31 may cause the counting unit 80 to start to count the time elapsed until the display of the setting screen 45A on the manipulation panel 40 is deleted, and may change the value of the time count start flag 68A from 1 to 0. That is, the CPU 31 may decide that count of the time elapsed until the display of the setting screen 45A is deleted has been started and thereby may change the value of the time count start flag 68A from a state in which there is a need to start to count the time elapsed until the display of the setting screen 45A is deleted to a state in which there is no need to start to count the time elapsed until the display of the setting screen 45A is deleted. If the setting screen 45A has not been displayed because, for example, a manipulation to complete the setting of setting items on the setting screen 45A or a manipulation to delete the setting screen 45A from the manipulation panel 40 has been accepted from the user, the CPU 31 may change the value of the time count start flag 68A to 0 without causing the counting unit 80 to start count of a time. If the CPU 31 decides that the time elapsed until the display of the setting screen 45 is deleted has elapsed after the start of the count of the time elapsed until the display of the setting screen 45A is deleted, the CPU 31 may delete the setting screen 45 from the manipulation panel 40 except if the setting screen 45A has been already deleted from the manipulation panel 40 due to the reasons described above. This is also true for the feed trays 51B and 51C. The initial value of the time elapsed until the display of the setting screen 45 corresponding to each feed trays 51 is deleted may be, for example 30 seconds. In the setting screen display processing, which will be described later in detail, however, the initial value may be changed.

A case in which the CPU 31 sets 1 in the time count start flags 68A, 68B, 68C and 68D according to the value of the sheet presence/absence flags 65A, 65B, 65C and 65D and the signals output from the sheet presence/absence sensors 64A, 64B, 64C and 64D will be described by taking the feed tray 51A as an example.

If there is no sheet S in the feed tray 51A because, for example, all the sheets S in the feed tray 51A have been subjected to printing, the sheet presence/absence sensor 64A may transmit a signal to the CPU 31 in correspondence to the fact that there is no sheet S in the feed tray 51A and the CPU 31 may set the value of the sheet presence/absence flag 65A to 0. If, in this situation, the sheet presence/absence sensor 64A transmits a signal to the CPU 31 in correspondence to the fact that sheets S are placed in the feed tray 51A, the CPU 31 may decide that sheets S have been supplied to the feed tray 51A because the value of the sheet presence/absence flag 65A is 0. That is, the CPU 31 may decide that a change has occurred from the state in which there is no sheet S in the feed tray 51A to the state in which there are sheets S in the feed tray 51A and thereby may decide that the user has placed sheets S in the feed tray 51A. The CPU 31 then may changes the value of the sheet presence/absence flag 65A to 1 and may store 1 in the time count start flag 68A. This is also true for the feed trays 51B and 51C and the MP feed tray 51D.

As described above, the CPU 31 may decide whether to store 1 in each time count start flag 68 according to a combination of the value of each mounting/demounting flag 62 and a signal output from the relevant mounting/demounting sensor 61 or to a combination of the value of each sheet presence/absence flag 65 and a signal output from the relevant sheet presence/absence sensor 64. There is no limitation to a case in which the value of the time count start flag 68 is set to 1; any case is applicable if a situation is detected in which a decision to start count of the time elapsed until the display of the setting screen 45 is deleted may be made. If, for example, the value of the mounting/demounting flag 62 is 0 and the mounting/demounting sensor 61 thereby transmits a signal in correspondence to the fact that the feed tray 51 eligible for detection is in the demounting state, the CPU 31 may change the value of the screen display flag 67 to 1 and may also change the value of the time count start flag 68 to 1. In this embodiment, as for the feed trays 51A, 51B, 51C, when the value of their corresponding mounting/demounting flags 62A, 62B, and 62C is 1 and a signal is output from their corresponding mounting/demounting sensors 61A, 61B, and 61C in correspondence to the mounting state, the CPU 31 may store 1 in their corresponding time count start flags 68. As for the MP feed tray 51D, when the value of the sheet presence/absence flag 65D is 0 and a signal is output from the sheet presence/absence sensor 64D in correspondence to presence of sheets, the CPU 31 may store 1 in the time count start flag 68D. That is, as for the feed trays 51A, 51B, and 51C, when they are mounted in the body cabinet 110, count of the time elapsed until the display of the setting screen 45 is deleted may be started; as for the MP feed tray 51D, when sheets are supplied to it, count of the time elapsed until the display of the setting screen 45 is deleted may be started.

As described above, the CPU 31 may perform display start detection processing (examples of first detection processing and second detection processing) in which the CPU 31 detects, according to signals output from the detectors 60, a situation (an example of a state change) in which the screen display flag 67 corresponding to each feed tray 51 is changed to 1 and may also perform time count start detection processing in which the CPU 31 starts count of time.

Setting screen display processing executed by the printer 100 will be described below with reference to FIG. 4, the processing being involved in a setting screen display function that displays each setting screen 45 on the manipulation panel 40 and also deletes the setting screen 45 from the manipulation panel 40.

Figure 4:
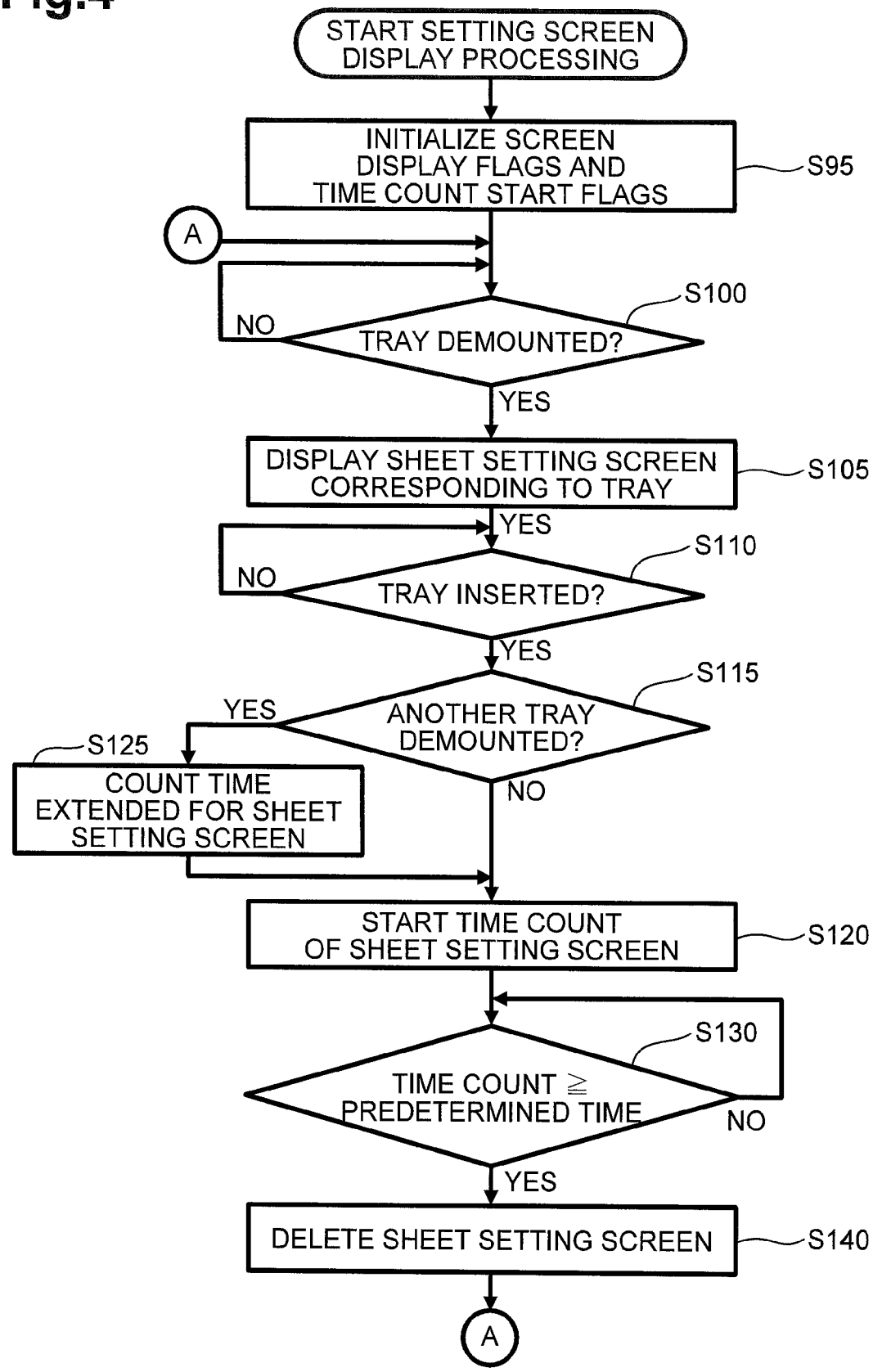
FIG. 4 is a flowchart depicting an example of setting screen display processing, in a first embodiment, that is executed by the printer.

FIG. 4 is a flowchart in setting screen display processing executed by the printer 100.

When the printer 100 is turned on, setting screen processing may be executed by the CPU 31 for each feed tray 51. In the description below, the feed tray 51A will be taken as an example. Setting screen display processing can be similarly performed for the feed trays 51B and 51C and the MP feed tray 51D as with the feed tray 51A.

When setting screen display processing is started, the CPU 31 may first store 0 in the screen display flag 67A and time count start flag 68A to initialize these flags due to the turning on of the printer 100 (S95).

The CPU 31 may then decide whether 1 is stored in the screen display flag 67A in the display start detection processing described above to decide whether to display the setting screen 45A in response to a change of the feed tray 51A (an example of a first sheet feed device) to the demounting state (S100).

If the CPU 31 decides that 1 is stored in the screen display flag 67A and thereby decides to display the setting screen 45A in response to a change of the feed tray 51A to the demounting state (the result of S100 is Yes), the CPU 31 may start to display the setting screen 45A corresponding to the feed tray 51A on the manipulation panel 40 (S105). The CPU 31 may then change the value of the screen display flag 67A to 0 and may move the process to S110.

If the CPU 31 decides that 0 is stored in the screen display flag 67A and thereby decides not to display the setting screen 45A in response to a non-change of the feed tray 51A to the demounting state (the result of S100 is No), the CPU 31 may return to S110 without displaying the setting screen 45A.

In the processing in S110, the CPU 31 may decide whether 1 is stored in the time count start flag 68A in the time count start detection processing described above and thereby may decide whether to start to count the time elapsed until the display of the setting screen 45A is deleted due to the change of the feed tray 51A to the mounting state (S110).

If the CPU 31 decides that 1 is stored in the time count start flag 68A and thereby decides to start to count the time elapsed until the display of the setting screen 45A is deleted in response to a change of the feed tray 51A to the mounting state (the result in S110 is Yes), the CPU 31 may decide whether the value of the mounting/demounting flag 62B or 62C corresponding to at least one feed tray 51 other than feed tray 51A, that is, at least any one of the feed tray 51B and feed tray 51C (an example of a second sheet feed device), is 1 and thereby may decide whether at least one feed tray 51 other than feed tray 51A is demounted from the apparatus body (S115). A Yes decision in S110 is an example of a timing to start time count in the disclosure. In S115, the CPU 31 may decide whether the values of the mounting/demounting flags 62 corresponding to a plurality of feed trays 51 other than the feed tray 51A are 1 or whether the value of the mounting/demounting flag 62 corresponding to a particular feed tray 51 other than the feed tray 51A is 1. That is, the CPU 31 may decide whether the values of the mounting/demounting flags 62 corresponding to any number of feed trays 51 (including a particular feed tray 51) other than the feed tray 51A are 1.

If the CPU 31 decides that the values of the mounting/demounting flags 62 corresponding to all the feed trays 51 other than the feed tray 51A (that is, the feed trays 51B and 51C) are a non-1 and thereby decides that all the feed trays 51 other than the feed tray 51A are not demounted from the apparatus body (the result in S115 is No), the CPU 31 may not change the initial value of the time elapsed until the display of the setting screen 45A is deleted and may start time count (S120). In the processing in S130, the CPU 31 may decide whether the counting unit 80 has counted a predetermined time. If the CPU 31 decides that the counting unit 80 has not counted a predetermined time (the result of S130 is No), the CPU 31 may return to S130. If the CPU 31 decides that the counting unit 80 has counted a predetermined time (the result of S130 is Yes), the setting screen 45A may be deleted from the manipulation panel 40 (S140). Upon completion of the processing in S140, the CPU 31 may return to S100, where the CPU 31 decides whether to display the setting screen 45A in response to a change of the feed tray 51A to the demounting state. After count of the time elapsed until the display of the setting screen 45A is deleted has started, the CPU 31 may change the value of the time count start flag 68A to 0.

If the CPU 31 decides that the value of the mounting/demounting flag 62 corresponding to at least one feed tray 51 other than the feed tray 51A is 1 and thereby decides that the at least one feed tray 51 other than the feed tray 51A is demounted from the apparatus body (the result in S115 is Yes), the CPU 31 may extend the initial value of the time elapsed until the display of the setting screen 45 is deleted by 30 seconds (S125) and starts time count with the new value (S120). That is, since at least one feed tray 51 other than the feed tray 51A is demounted from the apparatus body, the setting screen 45 corresponding to the demounted feed tray 51 may be displayed besides the setting screen 45A corresponding to the feed tray 51A. In this situation, the setting screen 45A may be hidden behind a setting screen 45 other than the setting screen 45A or the user may be checking a setting screen 45 other than the setting screen 45A or may be making a setting on a setting screen 45 other than the setting screen 45A. If, in this state, count of the time elapsed until the display of the setting screen 45A is deleted is started as usual, the setting screen 45A may be deleted before, for example, the user checks the setting screen 45A or makes a setting on it. If the time elapsed until the display of the setting screen 45A is deleted is extended, therefore, the setting screen 45A may be displayed for a longer time and the possibility that the display of the setting screen 45A is deleted before, for example, the user checks the setting screen 45A or makes a setting on it may be lowered. The start of counting the time elapsed until the display of the setting screen 45A is deleted may be delayed by a prescribed time, instead of extending the time elapsed until the display of the setting screen 45A is deleted. Alternatively, the start of counting the time elapsed until the display of the setting screen 45A is deleted may be delayed until all the demounted feed trays 51 are mounted. That is, any processing may be acceptable if the time during which the setting screen 45A is displayed is extended. Upon completion of the processing in S125, in the processing in S130, the CPU 31 may decide whether the counting unit 80 has counted a predetermined time. If the CPU 31 decides that the counting unit 80 has not counted a predetermined time (the result of S130 is No), the CPU 31 may return to S130. If the CPU 31 decides that the counting unit 80 has counted a predetermined time (the result of S130 is Yes), the setting screen 45A may be deleted from the manipulation panel 40 (S140). Upon completion of the processing in S140, the CPU 31 may return to S100, where the CPU 31 decides whether to display the setting screen 45A in response to a change of the feed tray 51A to the demounting state. After count of the time elapsed until the display of the setting screen 45A is deleted has started, the CPU 31 may change the value of the time count start flag 68A to 0.

As described above, in the processing in S105, after the CPU 31 has decided to display the setting screen 45A in response to a change of the feed tray 51A (the result of S100 is Yes), the CPU 31 may display the setting screen 45A corresponding to the feed tray 51A on the manipulation panel 40. The processing is an example of display processing in the disclosure.

As described above, a setting about the type of the sheet S can be accepted from the user while the setting screen 45A is displayed. This processing is an example of setting processing in the disclosure.

As described above, in S120, after the setting screen 45A has been displayed in S105, count of the time may be started by the counting unit 80. The processing is an example of time count processing in the disclosure.

As described above, after the counting unit 80 has counted a predetermined time, the setting screen 45A may be deleted from the manipulation panel 40. This processing is an example of deletion processing in the disclosure.

Since setting screen display processing is carried out for each feed tray 51, if the value of the mounting/demounting flag 62 corresponding to a feed tray 51 other than the feed tray 51A is 1, the setting screen 45 corresponding to the feed tray 51 other than the feed tray 51A may be displayed on the manipulation panel 40. This processing is an example of second display processing in the disclosure.

Particularly, the displaying of the setting screen 45A in S105 may become a timing to start count of the time elapsed until the display of the setting screen 45A is deleted (the result in S110 is Yes). Therefore, if it is decided whether there is a change in the state concerning the placement and removal of sheets S in the body cabinet 110, particularly whether at least one feed tray 51 other than the feed tray 51A is demounted, furthermore whether the setting screen 45 corresponding to the at least one feed tray 51 other than the feed tray 51A is displayed (S115) and thereby it is decided that there is a change in the state concerning the placement and removal of sheets S (the result in S115 is Yes), the time elapsed until the display of the setting screen 45A is deleted may be extended (S125) when compared with a case in which it is decided that there is no change in the state concerning the placement or removal of sheets S (the result in S115 is No). A series of this processing to extend the time during which the setting screen 45A is displayed by extending the time elapsed until the display of the setting screen 45A in this way is an example of delay processing in the disclosure.

Although, in this embodiment, a decision has been made for the feed trays 51B and 51C in the processing in S115, where it is decided whether the setting screen 45 corresponding to a feed tray 51 other than the feed tray 51A is being displayed, this is not a limitation; a decision may be made as to whether the setting screen 45D corresponding to the MP feed tray 51D (example of the second sheet feed device) is being displayed. In this case, in S115, whether the setting screen 45D is being displayed on the manipulation panel 40 can be decided by, for example, deciding whether the value of the sheet presence/absence flag 65D is 1 and a time from when the value of the sheet presence/absence flag 65D is changed from 0 to a value corresponding to 1, that is, from when count of the time elapsed until the display of the setting screen 45D is deleted is started until the display of the setting screen 45D is deleted, is not exceeded, besides a decision as to whether the value of the mounting/demounting flag 62 is 1.

In this embodiment, if the setting screen 45 corresponding to a feed tray 51 other than the feed tray 51A is being displayed while the setting screen 45A is displayed, the time during which the setting screen 45A is displayed may be extended. That is, when a plurality of setting screens 45 are displayed, the time during which the setting screen 45A is displayed can be extended, on the assumption that, for example, the user may not have checked the setting screen 45A or may not have made a setting on it. Therefore, even while a plurality of setting screens 45 are displayed, convenience can be improved for a particular setting screen 45 when, for example, the user checks the setting screen 45 or makes a setting on it.

When different setting screens 45 are displayed so as to be partially overlaid, if the setting screen 45 corresponding to a feed tray 51 other than the feed tray 51A is being displayed while the setting screen 45A is displayed, the time during which the setting screen 45A is displayed may be extended. That is, when different setting screens 45 are displayed so as to be partially overlaid, the time during which the setting screen 45A is displayed can be extended, on the assumption that, for example, the user may not have checked the setting screen 45A or may not have made a setting on it. Therefore, even when different setting screens 45 are displayed so as to be partially overlaid, convenience can be improved for a particular setting screen 45 when, for example, the user checks the setting screen 45 or makes a setting on it.

In a case, as well, in which a setting screen 45 is displayed in response to a change of its corresponding feed tray 51 to the demounting state, convenience can be improved for the setting screen 45 when, for example, the user checks the setting screen 45 or makes a setting on it.

In a case, as well, in which count of the time elapsed until the display of a setting screen 45 is deleted in response to a change of its corresponding feed tray 51 to the mounting state, convenience can be improved for the setting screen 45 when, for example, the user checks the setting screen 45 or makes a setting on it.

In a case, as well, in which processing to extend the time during which a setting screen 45 is displayed is executed when count of the time elapsed until the display of the setting screen 45 is deleted is started, convenience can be improved for a particular setting screen 45 when, for example, the user checks the setting screen 45 or makes a setting on it.

In a case, as well, in which the time during which a setting screen 45 is displayed is extended by delaying a timing at which to start count of the time elapsed until the display of the setting screen 45 is deleted, convenience can be improved the setting screen 45 when, for example, the user checks the setting screen 45 or makes a setting on it.

The same effects as described above for the feed tray 51A can also be obtained for the feed trays 51B and feed tray 51C. For the MP feed tray 51D, the same effects as for the feed tray 51A can also be obtained except the effects obtained when the feed tray 51A changes to the demounting state or mounting state.

Second Embodiment

Next, a second embodiment will be described: the same descriptions as in the first embodiment will be omitted.

In the second embodiment, the feed trays 51 other than the feed tray 51A may each have a sensor that detects the type of sheets and their corresponding setting screens 45 may not be displayed on the manipulation panel 40.

Setting screen display processing in the second embodiment may be executed by the CPU 31 only for the feed tray 51A when the printer 100 is turned on.

In this structure in the second embodiment, as in the first embodiment, the CPU 31 may decide in S115 whether the value of the mounting/demounting flag 62 corresponding to at least one feed tray 51 other than feed tray 51A, that is, at least any one of the feed tray 51B and feed tray 51C (an example of the second sheet feed device), is 1 and thereby may decide whether at least one feed tray 51 other than feed tray 51A is demounted from the apparatus body.

If the CPU 31 decides that the values of the mounting/demounting flags 62 corresponding to all the feed trays 51 other than the feed tray 51A are a non-1 and thereby decides that all the feed trays 51 other than the feed tray 51A are mounted in the apparatus body (the result in S115 is No), the CPU 31 may not change the initial value of the time elapsed until the display of the setting screen 45A is deleted and may start time count (S120).

If the CPU 31 decides that the value of the mounting/demounting flag 62 corresponding to at least one feed tray 51 other than the feed tray 51A is 1 and thereby decides that the at least one feed tray 51 other than the feed tray 51A is demounted from the apparatus body (the result in S115 is Yes), the CPU 31 may extend the initial value of the time elapsed until the display of the setting screen 45 is deleted by 30 seconds and may start count of a time-out with the new value (S120). That is, since at least one feed tray 51 other than the feed tray 51A is demounted from the apparatus body, the user may not pay attention to the manipulation panel 40 itself because, for example, the user is supplying sheets S to the at least one feed tray 51 other than the feed tray 51A. If, in this state, count of the time elapsed until the display of the setting screen 45A is deleted is started as usual, the setting screen 45 may be deleted before, for example, the user checks the setting screen 45A or makes a setting on it. Therefore, to lower the possibility that the display of the setting screen 45A is deleted before, for example, the user checks the setting screen 45A or makes a setting on it, the time elapsed until the display of the setting screen 45 is deleted may be extended so that the setting screen 45A is displayed for a longer time.

Particularly, the displaying of the setting screen 45A in S105 may become a timing to start count of the time elapsed until the display of the setting screen 45A is deleted (the result in S110 is Yes). Therefore, if it is decided whether there is a change in the state concerning the placement and removal of sheets S in a feed tray 51 other than the feed tray 51A, particularly whether at least one feed tray 51 other than the feed tray 51A is demounted (S115) and thereby it is decided that there is a change in the state concerning the placement and removal of sheets S (the result in S115 is Yes), the time elapsed until the display of the setting screen 45A is deleted may be extended (S125) when compared with a case in which it is decided that there is no change in the state concerning the placement and removal of sheets S (the result in S115 is No). A series of this processing to extend the time during which the setting screen 45A is displayed by extending the time elapsed until the display of the setting screen 45A is deleted in this way is an example of delay processing in the disclosure.

In this embodiment, if a change is detected in a state concerning the placement and removal of sheets S in a feed tray 51 other than the feed tray 51A, particularly a change from the mounting state to the demounting state is detected while the setting screen 45A is displayed, the time during which the setting screen 45A is displayed may be extended. That is, on the assumption that since the user may have demounted a feed tray 51 other than the feed tray 51A and is performing an operation concerning the placement and removal of sheets S, the user may not have made, for example, a check or a setting on the setting screen 45A, the time during which the setting screen 45A is displayed can be extended. Therefore, even while the user is performing an operation concerning the placement and removal of sheets S in a feed tray 51 other than the feed tray 51A, convenience can be improved for the setting screen 45A when, for example, the user checks the setting screen 45A or makes a setting on it.

The same effects as described above for the feed tray 51A can also be obtained for the feed trays 51B and 51C and the MP feed tray 51D.

Third Embodiment

Next, a third embodiment will be described with reference to FIGS. 5 and 6; the same descriptions as in the first embodiment will be omitted.

FIG. 5A schematically illustrates a demounting sequence table, and FIG. 5B schematically illustrates another demounting sequence table indicating a demounting sequence different from FIG. 5A.

Figure 6:
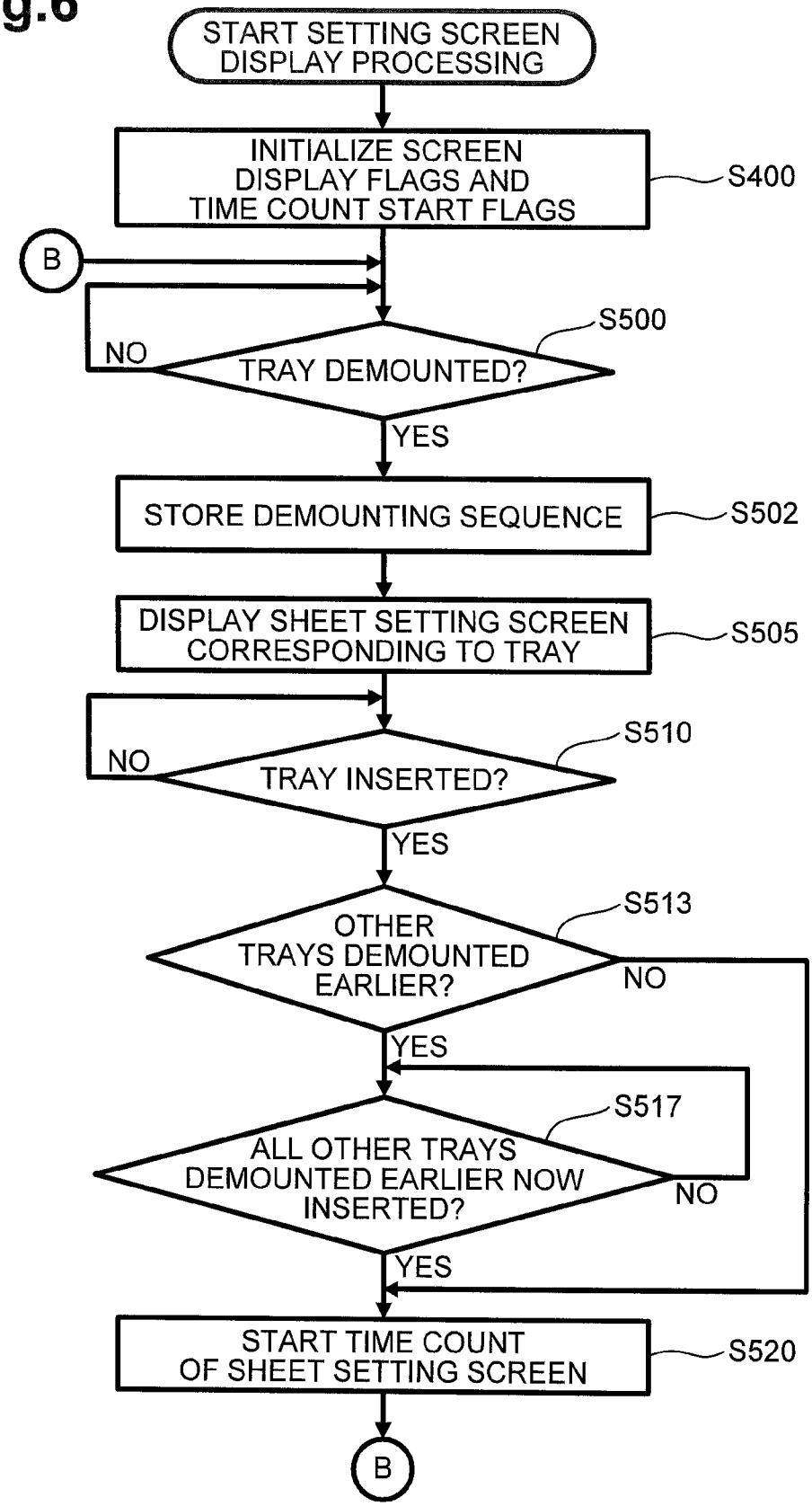
FIG. 6 is a flowchart depicting an example of setting screen display processing, executed by the printer, that differs from the setting screen display processing in the first embodiment.

FIG. 6 is a flowchart in setting screen display processing, executed by the printer 100, that differs from the setting screen display processing in the first embodiment.

In the third embodiment, demounting sequence tables as illustrated in FIGS. 5A and 5B may be stored in the RAM 33 (an example of a storage device).

Each demounting sequence table may store a demounting sequence (an example of a display sequence) in which feed trays 51 have been demounted and may also store, for each feed tray 51, an indication as to whether count of the time elapsed until the display of the setting screen 45 corresponding to the feed tray 51 is deleted, that is, a time-out, has been started.

The demounting sequence may be updated when the screen display flag 67 corresponding to one feed tray 51 is changed from 0 to 1. Specifically, for example, in the sequence illustrated in FIG. 5A, the feed tray 51A may be numbered 1 because the value of its corresponding screen display flag 67 have been changed to 1 first; the MP feed tray 51D may be numbered 4 because the value of its screen display flag 67 has been changed to 1 last. If the feed tray 51C, for example, in this sequence is demounted again, the value of its corresponding screen display flag 67C may be changed. Thus, the position of the MP feed tray 51D in the sequence may be changed from 4 to 3 and the position of the feed tray 51C may be changed from 3 to 4, as illustrated in FIG. 5B.

The indication as to whether time-out count has been started may be updated from "not started" to "started" when the value of the relevant time count start flag 68 is changed from 1 to 0 in response to the displayed setting screen 45. When the setting screen 45 has been completely set or does not need to be set and thereby its deletion is commanded on the manipulation panel 40, the relevant indication may also be updated from "not started" to "started". When another setting screen 45 is newly displayed, the relevant indication may also be updated from "started" to "not started".

In the third embodiment, when another setting screen 45 is newly displayed, it may be placed behind all the other already-displayed setting screens 45. Particularly, in a case as well in which an already-displayed setting screen 45 is displayed again, its position may be changed so as to be placed behind all the other already-displayed setting screens 45. The placing of a setting screen 45X behind a setting screen setting screen 45Y means that the setting screen 45Y is displayed on the setting screen 45X so that at least part of the setting screen 45Y is overlaid on the setting screen 45X. Specifically, a situation is conceivable in which, in FIG. 2, the setting screen 45A is read as referring to the setting screen 45Y and the setting screen 45B is read as referring to the setting screen 45X. The placing of the setting screen 45X ahead of the screen setting screen 45Y means that the setting screen 45X is displayed on the setting screen 45Y so that at least part of the setting screen 45X is overlaid on the setting screen 45Y. Specifically, a situation is conceivable in which, in FIG. 2, the setting screen 45A is read as referring to the setting screen 45X and the setting screen 45B is read as referring to the setting screen 45Y.

The CPU 31 may first initialize the screen display flags 67 and time count start flags 68 as in S95 (S400), after which the CPU 31 may reference the value of the screen display flag 67A to decide whether the feed tray 51A has been demounted (or sheets S have been supplied if the feed tray is the MP feed tray 51D) as in S100 (S500). If the CPU 31 decides that the feed tray 51A has been demounted (or sheets S have been supplied to the MP feed tray 51D) (the result in S500 is Yes), the CPU 31 may register the feed tray 51A at the end of the sequence in the demounting sequence table (S502). If the CPU 31 decides that the feed tray 51A has not been demounted (or sheets S have not been supplied to the MP feed tray 51D) (the result in S500 is No), the CPU 31 may return to S500.

If setting screens 45 are already displayed on the manipulation panel 40 as in S105 after the feed tray 51A has been registered in the demounting table in S502, the CPU 31 may display the setting screen 45A corresponding to the feed tray 51A behind all of these setting screens 45 (S505). The CPU 31 may then move the process to S510.

In S510, the CPU 31 may reference the value of the time count start flag 68A to decide whether the feed tray 51A has been mounted (or sheets S have been supplied if the feed tray is the MP feed tray 51D) and thereby may decide whether to start to count the time elapsed until the display of the setting screen 45A is deleted, as in S110.

If the CPU 31 decides in S510 that the feed tray 51A has been mounted (or sheets S have been supplied if the feed tray is the MP feed tray 51D) and thereby decides to start to count the time elapsed until the display of the setting screen 45A is deleted (the result in S510 is Yes), the CPU 31 may decide whether there are feed trays 51 indicated ahead of the feed tray 51A in the demounting sequence in the demounting sequence table and thereby may decide whether setting screens 45 are being displayed ahead of the setting screen 45A (S513). That is, the CPU 31 may decide whether there is the possibility that setting screens 45 are being displayed ahead of the setting screen 45A.

If the CPU 31 decides that there are feed trays 51 indicated ahead of the feed tray 51A in the demounting sequence in the demounting sequence table and thereby decides that setting screens 45 may be being displayed ahead of the setting screen 45A (the result in S513 is Yes), the CPU 31 may decide, for the feed trays 51 corresponding to all the setting screens 45 displayed ahead of the setting screen 45A, whether the indication of the start of time-out count is "started" and thereby may decide, for each setting screen 45 displayed ahead of the setting screen 45A, whether count of the time elapsed until the display of the setting screen 45 is deleted has been started (S517). That is, the CPU 31 may decide that setting screens 45 may be being displayed ahead of the setting screen 45A and thereby may decide, for each setting screen 45 displayed ahead of the setting screen 45A, whether count of the time elapsed until the display of the setting screen 45 is deleted has been started. The CPU 31 may repeat the processing in S517 until the CPU 31 decides, for each setting screens 45 displayed ahead of the setting screen 45A, that the indication of the start of time-out count for the feed tray 51 corresponding to the setting screen 45 is "started" and thereby decides, for each setting screen 45 displayed ahead of the setting screen 45A, that count of the time elapsed until the display of the setting screen 45 is deleted has been started (as long as the result in S517 is No).

If the CPU 31 decides, for each setting screens 45 displayed ahead of the setting screen 45A, that the indication of the start of time-out count for the feed tray 51 corresponding to the setting screen 45 is "started" and thereby decides, for each the setting screen 45 displayed ahead of the setting screen 45A, that count of the time elapsed until the display of the setting screen 45 is deleted has been started (the result in S517 is Yes), the CPU 31 may start count of the time elapsed until the display of the setting screen 45A is deleted as in S120 (S520).

In a case as well in which the CPU 31 decides that there is no feed tray 51 indicated ahead of the feed tray 51A in the demounting sequence in the demounting sequence table and thereby decides that no setting screen 45 is being displayed ahead of the setting screen 45A (the result in S513 is No), the CPU 31 may start time-out count for the setting screen 45A as in the processing in S120 (S520). That is, since the time counted until the display of the setting screen 45 corresponding to each feed tray 51 is deleted is the same, if time count for the setting screen 45A is started after time counts for all setting screens 45 that may be being displayed ahead of the setting screen 45A have been started, the time during which the setting screen 45A is displayed can be extended so that the setting screen 45A is displayed for a time longer than the time counted until the display of each setting screen 45 that may be being displayed ahead of the setting screen 45A is deleted.

If the CPU 31 decides in S510 that the feed tray 51A has not been mounted (or sheets S have not been supplied if the feed tray is the MP feed tray 51D) and thereby decides not to start to count the time elapsed until the display of the setting screen 45A is deleted (the result in S510 is No), the CPU 31 may return to S500, where the CPU 31 decides whether the state of feed tray 51A has changed to the demounting state (or sheets have not been supplied if the feed tray is the MP feed tray 51D) and thereby decides whether to display the setting screen 45A.

As described above, the CPU 31 may decide whether there are feed trays 51 indicated ahead of the feed tray 51A in the demounting sequence in the demounting sequence table and thereby may decide whether setting screens 45 are being displayed ahead of the setting screen 45A (S513). If the CPU 31 then decides that setting screens 45 are being displayed ahead of the setting screen 45A (the result in S513 is Yes), since the time counted until the display of each setting screen 45 is deleted is the same for all feed trays 51, when time count for the setting screen 45A is started after time counts for all setting screens 45 that are being displayed ahead of the setting screen 45A have been started (S517 and S520), the time during which the setting screen 45A is displayed may be extended so that the setting screen 45A is displayed for a time longer than the time counted until the display of each setting screen 45 displayed ahead of the setting screen 45A is deleted. A series of this processing to extend the time during which the setting screen 45A is displayed in this way is an example of delay processing in the disclosure. When this setting screen display processing is applied to all feed trays 51, the time elapsed until the display of each setting screen 45 is deleted may be started in succession from the topmost setting screen 45. Accordingly, count of the time elapsed until the display of the setting screen 45A is deleted may be started so that the setting screen 45A is deleted before the setting screens 45 displayed behind the setting screen 45A are deleted.

Although, in the third embodiment, another setting screen 45 has been newly displayed behind all the other already-displayed setting screens 45, this is not a limitation; another setting screen 45 may be newly displayed ahead of all the other already-displayed setting screens 45. In this case, the CPU 31 may decide in the processing in S513 whether there are feed trays 51 indicated behind the feed tray 51A in the demounting sequence in the demounting sequence table and thereby may decide whether setting screens 45 are being displayed ahead of the setting screen 45A.

Effects

In this embodiment, when the setting screen 45 is hidden behind another setting screen 45, the time during which the setting screen 45A is displayed may be extended so that the setting screen 45A is deleted after the setting screen 45 displayed ahead of the setting screen 45A has been deleted. This assures the time during which the setting screen 45A is displayed as the topmost screen. Therefore, convenience can be improved for a setting screen 45 displayed behind another setting screen 45 when, for example, the user checks the setting screen 45 or makes a setting on it.

When the setting screen 45A hides another setting screen 45, the time during which the setting screen 45 may be extended so that the setting screen 45A is deleted before the other setting screen 45 is deleted. That is, it is possible to lower not only the possibility that the hidden setting screen 45 is deleted before, for example, the user checks the setting screen 45 or makes a setting on it, but also the possibility that the setting screen 45A is deleted before, for example, the user checks the setting screen 45A or makes a setting on it. Therefore, convenience can be improved for a setting screen 45 displayed ahead of another setting screen 45 when, for example, the user checks the setting screen 45 or makes a setting on it.

In the structure in which the newer the setting screen 45 is, the more it is displayed at the back, convenience can be improved for each setting screen 45 when, for example, the user checks the setting screen 45 or makes a setting on it.

Particularly, when a display sequence of setting screens 45 is stored and a decision is made about it and thereby it is decided that the setting screen 45A may be hidden behind another setting screen 45, the time during which the setting screen 45A is displayed may be extended so that the setting screen 45A is deleted after the setting screen 45 ahead of the setting screen 45A has been deleted. Therefore, convenience can be improved for a setting screen 45 that is determined to be being displayed behind another setting screen 45 in consideration of its more forward position in the display sequence when, for example, the user checks the setting screen 45 or makes a setting on it.

The same effects as described above for the feed tray 51A can also be obtained for the feed trays 51B and 51C and the MP feed tray 51D.

Other Embodiments (1) Although, in the above embodiments, the image forming apparatus has been exemplified by the printer 100, this is not a limitation: the image forming apparatus may be, for example, an inkjet printer or a multi-function peripheral having not only a print function but also a copy function and a facsimile function.

(2) Although, in the above embodiments, a single CPU 31 has executed processing, a plurality of CPUs 31 may execute processing. Alternatively, only a hardware circuit such as an application-specific integrated circuit (ASIC) or a combination of the CPU 31 and a hardware circuit may execute processing.

(3) In the above embodiments, the placement and removal of sheets S, which are an example of a member to be placed and removed, have been detected by using a signal transmitted from the mounting/demounting sensor 61 or the sheet presence/absence sensor 64, which is the second sensor, to the CPU 31. In this structure, if it is decided that a change will be detected in the state concerning the placement or removal of sheets S, the time during which the setting screen 45 corresponding to a feed tray 51 other than the feed tray 51 in which the placement or removal of sheets S has been detected is displayed has been extended when compared with a case in which it is decided that no change will be detected in the state concerning the placement or removal of sheets S. However, the member to be placed and removed is not limited to the sheets S and the second sensor is not limited to the mounting/demounting sensor 61 or sheet presence/absence sensor 64. For example, a toner cartridge (an example of a storage vessel) that stores toner (an example of a recording member) used to form an image on a sheet S may be used a member to be mounted in and demounted from the body cabinet 110. A sensor that detects the opening and closing of the cover of an accommodating device (an example of an accommodating device), disposed in the body cabinet 110, that accommodates the toner cartridge may be used as the second sensor. A signal transmitted from the sensor to the CPU 31 may be used to detect a change in a state concerning the mounting and demounting of the toner cartridge. In this structure, if, for example, the cover is open, it may be decided that a change will be detected in the state concerning the mounting and demounting of the toner cartridge because the user is likely to be performing an operation concerning the replacement of toner cartridge. Thus, if it is decided that a change will be detected in the state concerning the mounting and demounting of the toner cartridge, the time during which the setting screen 45 corresponding to the a feed tray 51 is displayed may be extended when compared with a case in which it is decided that a change will not be detected in the state concerning the mounting and demounting of the toner cartridge. Thus, the setting screen 45 can be displayed for a longer time, on the assumption that since the user is performing an operation concerning the replacement of toner cartridge, the user may not have checked the setting screen 45 or may not have made a setting on it. Therefore, convenience can be improved for the setting screen 45 when, for example, the user checks the setting screen 45 or makes a setting on it. With an inkjet printer or the like, a change may be detected in the state concerning the mounting and demounting of an ink cartridge instead of a toner cartridge. Furthermore, for example, the second sensor may be used as a sensor that detects a manipulation on the setting screen 45 corresponding to a feed tray 51 other than a feed tray 51X (X: A, B, C, or D) for which setting screen display processing is being carried out. A signal transmitted from the sensor to the CPU 31 may be used to detect a manipulation made on the setting screen 45 due to placement or removal of sheets S in the feed tray 51 other than the feed tray 51X as a change in a state concerning the placement and removal of sheets S. In this structure, if it is decided that as a change in the state concerning placement and removal of sheets S, a manipulation will be detected on the setting screen 45 due to placement or removal of sheets S in a feed tray 51 other than the feed tray 51X, the time during which the setting screen 45X corresponding to the feed tray 51X is displayed may be extended when compared with a case in which it is decided that a manipulation will not be detected on the setting screen 45 due to placement or removal of sheets S in a feed tray 51 other than the feed tray 51X. Thus, the setting screen 45X can be displayed for a longer time, on the assumption that since the user is manipulating a setting screen 45 due to placement or removal of sheets S in a feed tray 51 other than the feed tray 51X, the user may not have checked the setting screen 45X or may not have made a setting on it. Therefore, convenience can be improved for the setting screen 45X when, for example, the user checks the setting screen 45X or makes a setting on it.

(4) In the above embodiments, the displaying of the setting screen 45A has been used as a timing to start count of the time elapsed until the display of the setting screen 45A is deleted, and the time elapsed until the display of the setting screen 45A is deleted has been extended depending on the condition. However, this is not a limitation; the time elapsed until the display of the setting screen 45A is deleted may be extended at any timing from when the setting screen 45A is displayed until it is deleted, for example, at the timing of deleting the setting screen 45A, depending on the condition. Furthermore, the number of times processing to extend the time elapsed until the display of the setting screen 45A is deleted is performed is not limited to one; the processing may be performed a plurality of times. This is not limited to the feed tray 51A, but is also true for the feed trays 51B and 51C and the MP feed tray 51D.

(5) In the above embodiments, the sheet feed tray units have been the feed trays 51A, 51B and 51C and the MP feed tray 51D mountable in and demountable from the apparatus body 100. However, this is not a limitation; an example of the sheet feed tray unit is a manual feed tray in which a sheet S is struck against rollers so that only the top of the sheet S is supplied and it is thereby held. In a manual feed tray, a sensor that detects the presence or absence of a sheet may be provided, for example, ahead of the rollers to detect the presence or absence of a sheet and make a decision under the same condition as for the MP feed tray 51D.

What is claimed is:

1. An image forming apparatus comprising:

a body;

a sheet feed device;

an image forming device configured to form an image on a sheet fed from the sheet feed device;

a first sensor configured to output a first signal according to a first state concerning placement and removal of a sheet in the sheet feed device or output a first signal according to a first state concerning mounting and demounting of the sheet feed device;

a second sensor configured to output a second signal according to a second state concerning placement and removal or mounting and demounting of a member, the member being placement and removal in another sheet feed device or being mounted in and demounted from the body;

a display; and a control device configured to:

detect a first change in the first state based on the first signal output from the first sensor;

detect a second change in the second state based on the second signal output from the second sensor;

control the display to display first display information that prompts setting of a setting concerning a type of a sheet to be supplied to the sheet feed device on the display in response to the detection of the first change;

count a time, the counting being started after the first display information has been displayed on the display;

delete the first display information from the display after a prescribed time has been counted; and extend a display time displaying the first display information on the display, when the second change is detected while the first display information is displayed on the display, the display time is extended compared with a case in which, the second change is not detected while the first display information is displayed on the display.

2. The image forming apparatus according to claim 1, wherein:

the first sensor further includes a mounting/demounting sensor configured to output the first signal according to mounting or demounting of the sheet feed device, the sheet feed device is mountable in and demountable from the body; and the control device is further configured to detect the first change which changes from the first signal according to the mounting of the sheet feed device to the first signal according to the demounting of the sheet feed device.

3. The image forming apparatus according to claim 1, wherein:

the first sensor further includes a mounting/demounting sensor configured to output the first signal according to mounting or demounting of the sheet feed device, the sheet feed device is mountable in and demountable from the body; and the control device is further configured to start the counting of the time at a timing at which the control device detects the first change which changes from the first signal according to the demounting of the sheet feed device to the first signal according to the mounting of the sheet feed device.

4. The image forming apparatus according to claim 1, wherein the control device is configured to extend the display time by delaying the timing at which the counting is started.

5. The image forming apparatus according to claim 1, further comprising an accommodating device configured to accommodate a storage vessel in which a recording member is stored, an image being formed on the recording member by the image forming device, wherein the member that is mounted and demounted is the storage vessel.

6. The image forming apparatus according to claim 1, wherein:

a plurality of sheet feed devices are provided;

the sheet feed device is one of the plurality of sheet feed devices;

the member is a second sheet feed device which is a sheet feed device other than the sheet feed device;

the second sensor is configured to output the second signal according to the state concerning placement and removal of the sheet in the second sheet feed device; and the control device is configured to extend, when the second change is detected while the first display information is displayed on the display, the time during the first display information is displayed on the display as compared with a case in which the second change is not detected while the first display information is displayed on the display.

7. The image forming apparatus according to claim 6, wherein:

the control device is configured to control the display to display second information that prompts setting of a setting concerning a type of a sheet to be supplied to the second sheet feed device on the display in response to the second change, and the control device is configured to extend, when the second change is detected while the first display information is displayed on the display, the time during the first display information is displayed on the display as compared with a case in which the second change is not detected while the first display information is displayed on the display.

8. The image forming apparatus according to claim 7, wherein the control device is configured to display the first display information and the second display information so as to be at least partially overlaid.

9. The image forming apparatus according to claim 8, wherein, when the second display information is being displayed behind the first display information, the control device is configured to delete the first display information form the display before the second display information is deleted from the display.

10. The image forming apparatus according to claim 8, wherein, when the first display information is being displayed behind the second display information, the control device is configured to delete the first display information form the display after the second display information is deleted from the display.

11. The image forming apparatus according to claim 8, wherein new display information is displayed behind all pieces of display information that is being displayed.

12. An information displaying method of an image forming apparatus comprising a body, a sheet feed device, an image forming device configured to form an image on a sheet fed from the sheet feed device, a first sensor configured to output a first signal according to a first state concerning placement and removal of a sheet in the sheet feed device or output a first signal according to a first state concerning mounting and demounting of the sheet feed device, a second sensor configured to output a second signal according to a second state concerning placement and removal or mounting and demounting of a member, the member being placement and removal in another sheet feed device or being mounted in and demounted from the body, and a display, the method comprising:

detecting a first change in the first state based on the first signal output from the first sensor;

detecting a second change in the second state based on the second signal output from the second sensor;

controlling the display of first display information that prompts setting of a setting concerning a type of a sheet to be supplied to the sheet feed device on the display in response to detecting the first change;

counting a time, the counting being started after the first display information has been displayed on the display;

deleting the first display information from the display after a prescribed time has been counted; and extending a display time displaying the first display information on the display, when the second change is detected while the first display information is displayed on the display, the display time is extended as compared with a case in which the second change is not detected while the first display information is displayed on the display.

13. A non-transitory, computer-readable storage medium storing a computer-readable instruction executed by at least one processor of an image forming apparatus comprising a body, a sheet feed device, an image forming device configured to form an image on a sheet fed from the sheet feed device, a first sensor configured to output a first signal according to a first state concerning placement and removal of a sheet in the sheet feed device or output a first signal according to a first state concerning mounting and demounting of the sheet feed device, a second sensor configured to output a second signal according to a second state concerning placement and removal or mounting and demounting of a member, the member being placement and removal in another sheet feed device or being mounted in and demounted from the body, and a display, the instruction instructing a image forming apparatus to execute:

detecting a first change in the first state based on the first signal output from the first sensor;

detecting a second change in the second state based on the second signal output from the second sensor;

controlling the display of first display information that prompts setting of a setting concerning a type of a sheet to be supplied to the sheet feed device on the display in response to detecting the first change;

counting a time, the counting being started after the first display information has been displayed on the display;

deleting the first display information from the display after a prescribed time has been counted; and extending a display time displaying the first display information on the display, when the second change is detected while the first display information is displayed on the display, the display time is extended as compared with a case in which the second change is not detected while the first display information is displayed on the display.

* * * * *